US007779593B2

(12) United States Patent
Jahn et al.

(10) Patent No.: US 7,779,593 B2
(45) Date of Patent: Aug. 24, 2010

(54) WALL ANGLE WITH PRE-PUNCHED LOCATING TABS

(75) Inventors: Peter G. Jahn, Palos Park, IL (US); Scott G. Jankovec, Elmhurst, IL (US)

(73) Assignee: Chicago Metallic Corporation, Chicago, IL (US)

( * ) Notice: Subject to any disclaimer, the term of this patent is extended or adjusted under 35 U.S.C. 154(b) by 66 days.

(21) Appl. No.: 12/047,371

(22) Filed: Mar. 13, 2008

(65) Prior Publication Data

US 2008/0229680 A1 Sep. 25, 2008

Related U.S. Application Data

(60) Provisional application No. 60/896,013, filed on Mar. 21, 2007.

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04C 2/52*** | (2006.01) |

(52) U.S. Cl. ..... 52/506.06; 52/220.6; 52/506.07

(58) Field of Classification Search ..... 52/506.06, 52/506.07, 664, 220.6, 716.1, 718.04, 716.8
See application file for complete search history.

(56) References Cited

U.S. PATENT DOCUMENTS

| | | | | |
|---|---|---|---|---|
| 2,990,921 | A * | 7/1961 | Wilde | 403/178 |
| 3,979,874 | A * | 9/1976 | Cubbler et al. | 52/664 |
| 4,016,701 | A * | 4/1977 | Beynon | 52/506.07 |
| 4,062,164 | A * | 12/1977 | Cousins | 52/506.07 |
| 4,406,104 | A | 9/1983 | Beck et al. | |
| 4,586,841 | A | 5/1986 | Hunter | |
| 4,769,965 | A * | 9/1988 | Shaub | 52/506.07 |
| 5,363,622 | A * | 11/1994 | Sauer | 52/506.07 |
| 5,414,969 | A * | 5/1995 | Krejci et al. | 52/311.3 |
| 5,517,796 | A * | 5/1996 | Koski et al. | 52/506.07 |
| 6,305,137 | B1 * | 10/2001 | Rebman | 52/311.3 |
| 6,324,806 | B1 * | 12/2001 | Rebman | 52/465 |
| 6,516,581 | B2 * | 2/2003 | Paul et al. | 52/506.07 |

(Continued)

FOREIGN PATENT DOCUMENTS

AU 24938/71 2/1971

*Primary Examiner*—Richard E Chilcot, Jr.
*Assistant Examiner*—Andrew J Triggs
(74) *Attorney, Agent, or Firm*—Cook Alex Ltd.

(57) ABSTRACT

A wall angle for a suspended ceiling, which may either be a drywall suspended ceiling or a lay-in tile suspended ceiling, has a cross-section forming a substantially right angle of the vertical leg and a horizontal leg. The horizontal leg is adapted to support an inverted tee-runner that has a vertical web and opposed flanges, the opposed flanges being adapted to rest on the horizontal leg of the wall angle. The horizontal leg is formed with a plurality of pairs of locating tabs, at least one tab in each pair being upwardly extending and vertically-oriented. The tabs in each pair are spaced apart a distance sufficient to accommodate the width of the opposed flanges of the tee-runner. At least one of the tabs in each pair has a downwardly extending detent adapted to permit installation of a tee-runner, but to inhibit removal of the tee-runner. The pairs of tabs are spaced, on center, a pre-determined distance that depends upon the intended application of the wall angle.

6 Claims, 6 Drawing Sheets

U.S. PATENT DOCUMENTS

| | | | | |
|---|---|---|---|---|
| 6,516,582 | B2 * | 2/2003 | Paul et al. | 52/506.07 |
| 6,722,098 | B2 | 4/2004 | Platt | |
| 6,729,100 | B2 * | 5/2004 | Koski et al. | 52/506.05 |
| 6,843,033 | B2 * | 1/2005 | Okumura | 52/506.07 |
| 6,851,238 | B2 * | 2/2005 | Rebman | 52/506.07 |
| 7,240,460 | B2 * | 7/2007 | Platt | 52/506.07 |
| 7,278,243 | B2 * | 10/2007 | Jones et al. | 52/506.07 |
| 7,490,446 | B1 * | 2/2009 | Chuang | 52/664 |
| 2003/0172609 | A1 * | 9/2003 | Rebman | 52/506.07 |
| 2004/0098939 | A1 * | 5/2004 | Hsu | 52/506.07 |
| 2006/0010811 | A1 * | 1/2006 | Platt | 52/506.06 |
| 2006/0010812 | A1 * | 1/2006 | Jones et al. | 52/506.07 |
| 2007/0022690 | A1 * | 2/2007 | LaLonde | 52/506.07 |
| 2008/0229680 | A1 * | 9/2008 | Jahn et al. | 52/105 |
| 2008/0236068 | A1 * | 10/2008 | Jahn et al. | 52/220.6 |

* cited by examiner

FIG. 7
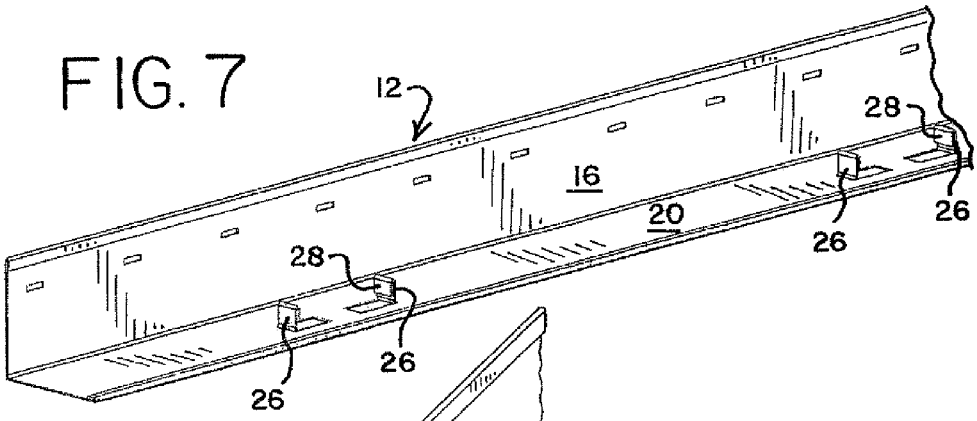
FIG. 8
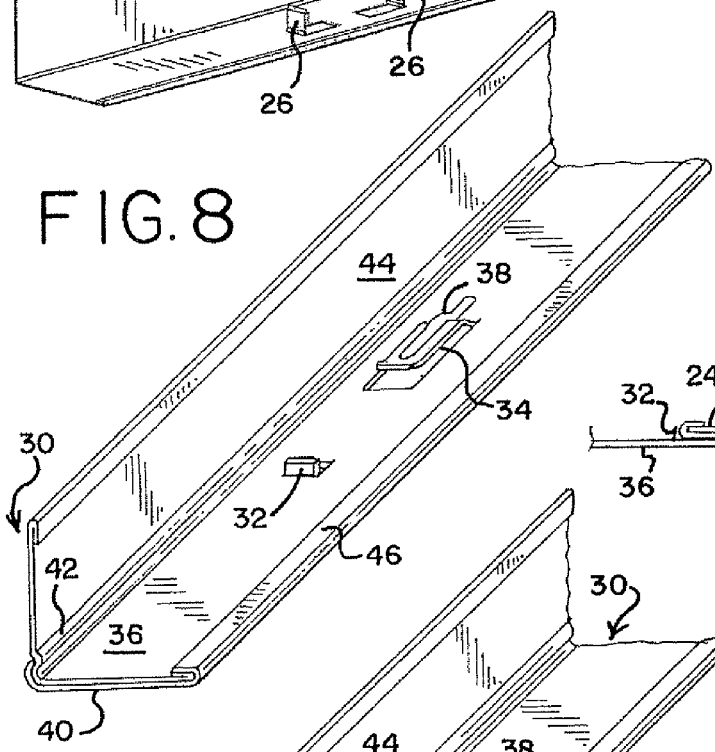
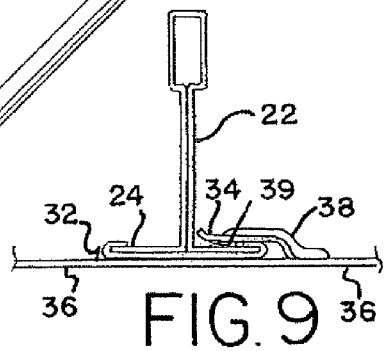
FIG. 9
FIG. 10
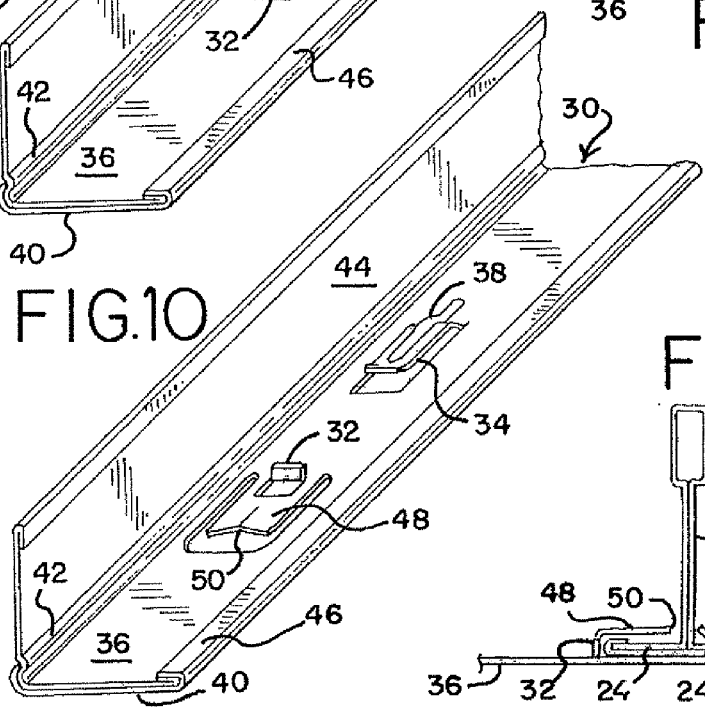
FIG. 11
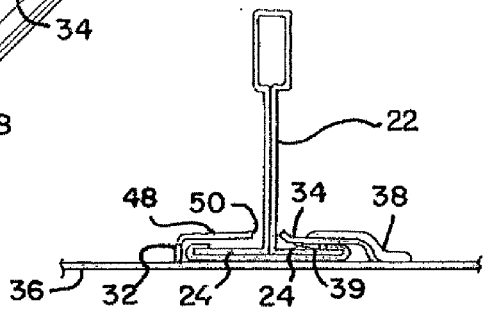

WALL ANGLE WITH PRE-PUNCHED LOCATING TABS

CROSS REFERENCE TO RELATED APPLICATION

This application claims the benefit of the filing date of U.S. Provisional Application Ser. No. 60/896,013, filed Mar. 21, 2007.

BACKGROUND

The present disclosure is directed to a wall angle that may be advantageously used as part of a suspension grid for either a drywall ceiling or for a suspended ceiling having lay-in or drop-in panels or tiles. In either case, the wall angles have vertical legs by which the wall angles are secured to the wall, and horizontal ledges that support the ends of tee-runners or beams and cross-tees that span the ceiling between opposed walls. When used as part of a drywall suspension system, the lower surfaces of the wall angles and associated beams do not need to be finished, as they are not seen after the drywall is fixed, by screws, to the suspension grid. Such is not the case when the suspension system is used for supporting lay-end ceiling tiles or panels. However, in both cases, it is important to maintain accurate spacing of the grid members, since the drywall and ceiling panels are in regular, rectangular shapes and sizes, typically 48 or 96 inches on center for drywall and 24 inches on center for ceiling tiles.

Wall angles having tabs or other structures for positioning and fixing the ends of the beams supported thereon are shown in, e.g., published U.S. patent applications 2006/0010811, 2006/0010812, and 2007/002690, which are incorporated herein by reference. The tabs or other structures shown in these published applications serve to ensure that the beams are properly spaced for their intended application.

SUMMARY OF THE DISCLOSURE

In one aspect of the disclosure, a wall angle for a suspended ceiling, which may either be a drywall suspended ceiling or a lay-in tile suspended ceiling, has a cross-section forming a substantially right angle of the vertical leg and a horizontal leg. The horizontal leg is adapted to support an inverted tee-runner that has a vertical web and opposed flanges, the opposed flanges being adapted to rest on the horizontal leg of the wall angle. The horizontal leg is formed with a plurality of pairs of locating tabs, at least one tab in each pair being upwardly extending and vertically-oriented. The tabs in each pair are spaced apart a distance sufficient to accommodate the width of the opposed flanges of the tee-runner. At least one of the tabs in each pair has a downwardly extending detent adapted to permit installation of a tee-runner, but to inhibit removal of the tee-runner. The pairs of tabs are spaced, on center, a pre-determined distance that depends upon the intended application of the wall angle.

In keeping with another aspect of the disclosure, the detent may comprise either an upper portion of the tabs that is folded downwardly or, alternatively, a lanced-out portion of the tabs.

In keeping with another aspect of the disclosure, the wall angle has opposed first and segment end segments that are complementarily-shaped so that when the wall angle is used with a second wall angle in end-to-end relationship, the first end segment of the wall angle mates with the second end segment of the second wall angle to properly position the wall angles relative to each other. This ensures that the locating tabs on adjacent wall angles are properly spaced. In keeping with another aspect of the disclosure, the first end segment is offset from the remainder of the wall angle so as to provide a stop for abutment by the second end segment of the second wall angle. Additionally, and preferably, the first and second end segments have interlocking members, the interlocking members may be complementarily-shaped.

In keeping with another aspect of the disclosure, the wall angle may include bendable tabs that help to secure the tee-runner to the wall angle. More specifically, the horizontal leg of the wall angle may have a tab that is foldable back onto one of the flanges of the tee-runner. Additionally, the vertical leg of the wall angle may have a tab that is bendable therefrom and adapted to be secured to the web of the tee-runner.

Other features of the disclosure will become apparent upon reference to the following detailed description and accompanying drawings.

BRIEF DESCRIPTION OF THE DRAWINGS

FIG. 7 is a perspective view of a third embodiment of a wall angle according to the present disclosure.

FIG. 8 is a perspective view of a fourth embodiment of a wall angle according to the present disclosure.

FIG. 9 is a front view of the wall angle of FIG. 8 in combination with a tee-runner, which is shown in profile.

FIG. 10 is a perspective view of a fifth embodiment of a wall angle according to the present disclosure.

FIG. 11 is a front view of the wall angle of FIG. 10 in combination with a tee-runner, which is shown in profile.

DETAILED DESCRIPTION OF THE PREFERRED EMBODIMENTS

Figure 1:
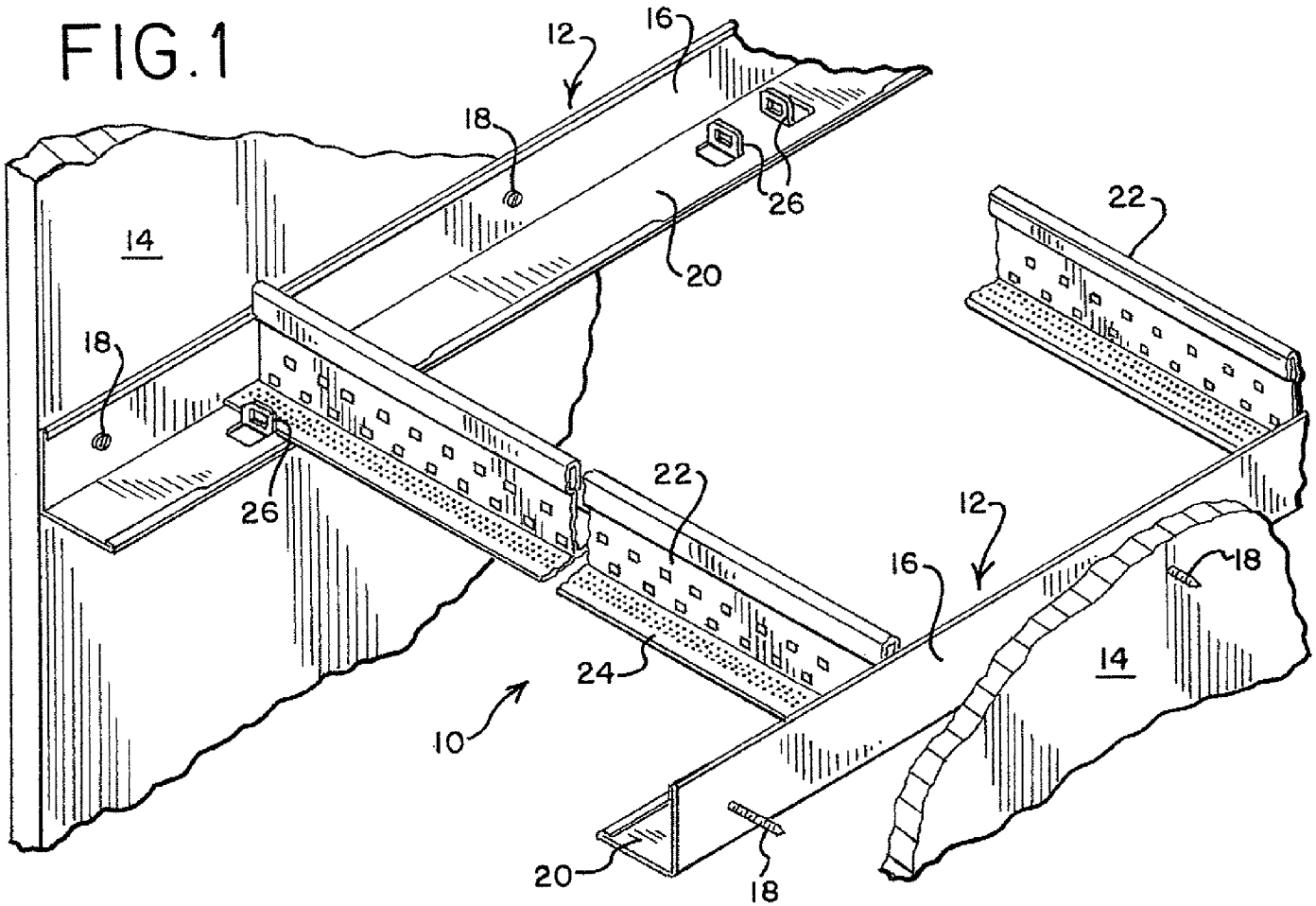
FIG. 1 is a fragmentary perspective view of a suspension grid for a drywall ceiling or a suspended ceiling in accordance with a first embodiment of the present disclosure.
Figure 2:
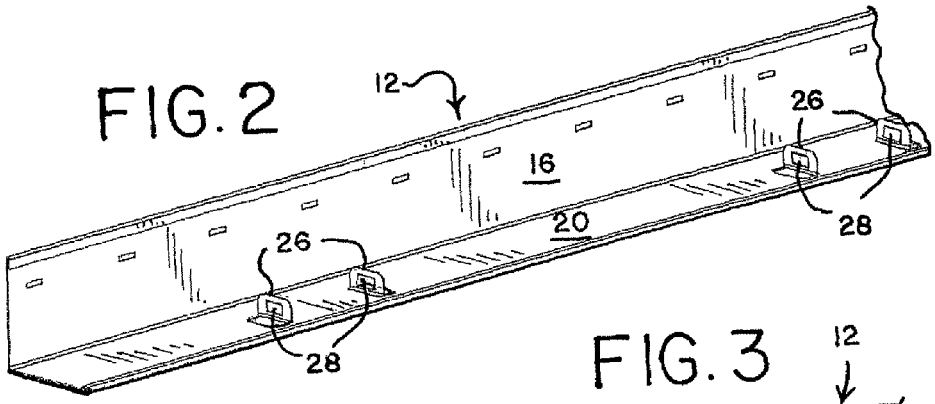
FIG. 2 is a perspective view of the wall angle shown in FIG. 1.
Figure 3:
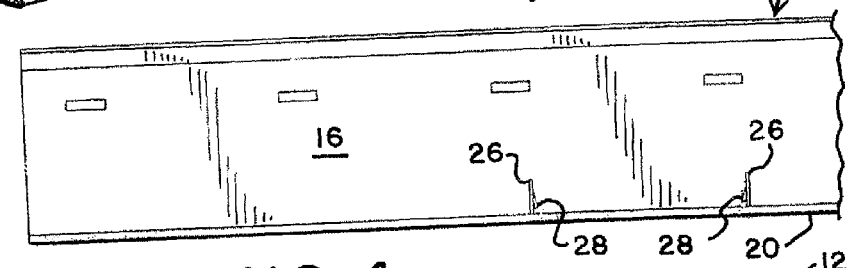
FIG. 3 is a front view of the wall angle of FIG. 2.
Figure 4:
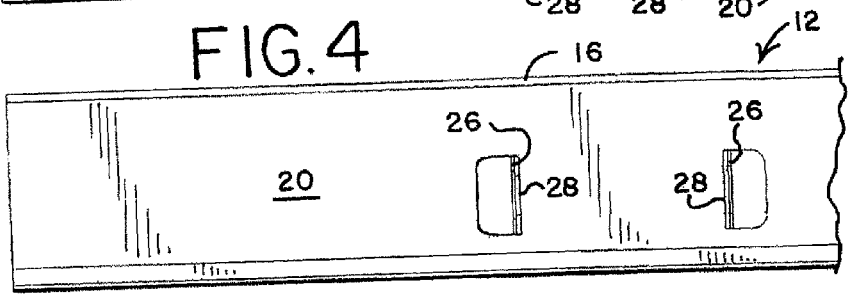
FIG. 4 is a top view of the wall angle of FIG. 2.
Figure 5:
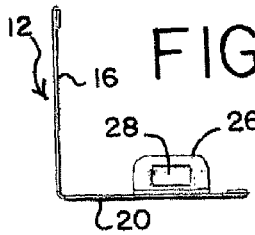
FIG. 5 is an end view of the wall angle of FIG. 2.

Turning to FIG. 1, there is seen a suspension grid system, generally designated 10, using a wall angle, generally designated 12, in accordance with the present disclosure. In a typical installation, a pair of wall angles 12 are secured to opposed walls 14 through their vertical legs 16 by e.g. screws 18, although nails, staples, and/or adhesives may also be used for this purpose. The horizontal legs or ledges 20 of the wall angles 12 support the ends of the beams or tees 22. If the grid is used in a drywall ceiling, the drywall sheets (not shown) are secured directly to the bottom sides of the horizontal flanges 24 of the beams 22 by screws. If the grid is used for a suspended ceiling, the top sides of flanges 24 and the horizontal legs 20 of the wall angle support the edges of lay-in tiles or panels (also not shown). The wall angles described herein may be used with either a dry wall suspended ceiling or a lay-in panel suspended ceiling, without departing from the disclosure.

Figure 6:
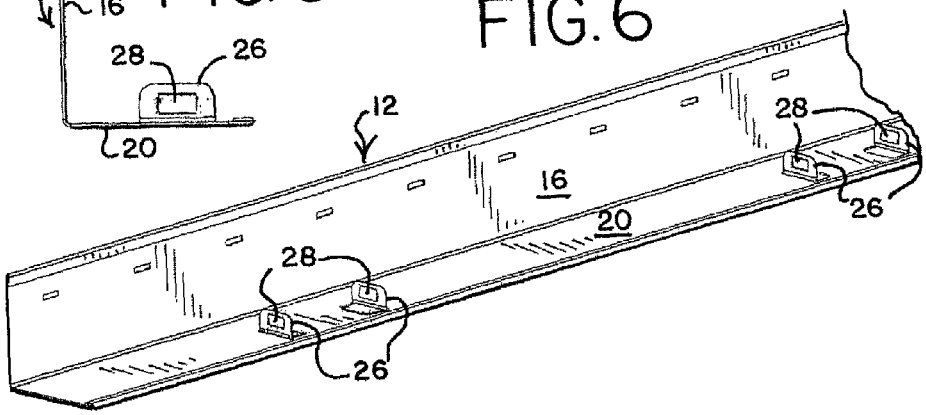
FIG. 6 is a perspective view of a second embodiment of a wall angle according to the present disclosure.

In keeping with one aspect of the disclosure, the horizontal legs 20 of the drywall angles 12 are provided with pairs of regularly spaced tabs for locating and securing the beams 22 to the wall angles 12. To this end, and with reference to FIGS. 1-5, a first embodiment of a wall angle 12 according to the present disclosure is shown. The wall angle 12 has a pair of tabs 26 lanced or punched from the horizontal ledge 20 of the wall angle 12. Both of the tabs 12 extend in a substantially vertical direction from the horizontal ledge. In the case of a wall angle for use with a dry wall grid suspension system, the pairs of tabs are preferably spaced 8 inches on center along the length of the wall angle, while the pairs of tabs are preferably spaced 24 inches on center along the length of the wall angle in the case of a wall angle for use in a drop-in tile-grid suspension system. In the embodiment of FIGS. 1-5, the tabs 26 are punched from the horizontal ledge 20 of the wall angle 12 so that the holes in the ledge 20 created thereby are outside of the space between the tabs 26. However, the tabs 26 could be punched from the ledge 20 so that the holes created thereby are between the tabs 28, as shown in FIG. 6, without departing from the disclosure.

The tabs 12 in each pair are spaced apart a distance sufficient to accommodate the width of the flanges 24 of an associated runner, and are preferably spaced apart a distance approximately equal to the width of the flanges 24 so that an associated runner 22 may be located between the tabs by moving it downwardly in a substantially vertical direction.

In order to prevent the runners 22 from being displaced from the wall angles 12 by an upwardly vertically-directed force, the tabs 26 include downwardly-directed detents 28 which allow the beams to be located between the tabs in a vertically downward motion, but prevent removal by a vertically upward motion. Preferably, the detents 28 engage the top sides of the flanges 24 of the beam 20 to provide for a more positive restraint against upward movement of the beam relative to the wall angle. As shown in FIGS. 1-5, the detents 28 may be lanced or punched from the central portion of the tabs 26 so as to extend downwardly from the upper portion of the tabs 26. Alternatively, the detents 28 may be formed simply by bending downwardly the top portion of the tabs 26, as shown in the embodiment of FIG. 7, without departing from the disclosure.

When used in a suspended ceiling grid for drop-in tiles, the tabs 26 are preferably sized in width so that when they are punched from the horizontal leg of the wall angle, they do not extend out from vertical leg a distance that would cause them to interfere with the drop-in ceiling panels.

Turning to FIG. 8, an alternate embodiment of a wall angle 30 according to the present disclosure as shown. Like the earlier described embodiments, the wall angle 30 includes spaced pairs of locating tabs 32, 34 lanced or punched from the horizontal ledge 36 of the wall angle 30. The tab 32 extends generally upwardly from the horizontal ledge 36 and, as best seen in FIG. 9, serves to locate an edge of the flange 24 of a beam 22 to maintain the desired spacing of the beams. Tab 34 extends generally horizontally toward tab 32, and may be formed with an embossment 38 for additional structural integrity.

With reference to FIG. 9, a beam is mounted to a wall angle 30 by first sliding one flange of the beam under the tab 34 and moving the beam laterally toward the tab 34 until the edge of the other flange clears the tab 32 and both flanges are supported directly upon the flat portion of the horizontal ledge 36 of the wall angle 30. The runner is then moved laterally back toward the tab 32 until the edge of the flange abuts the tab 32. Optionally, the tab 34 may include a downwardly projecting detent 39 that engages the edge of a hem on the flange to prevent inadvertent dislocation of the beam 22 relative to the wall angle 30 should the beam 22 become subjected to a clockwise rotational force (when viewed in FIG. 9).

As noted above, when the wall angle of the present disclosure is used as part of a suspended ceiling grid, the bottom surface of the horizontal ledge remains visible after installation. In order to provide the lower surface of the horizontal ledge with a continuous surface, which may be more esthetically pleasing, the wall angle may have a cap 40 applied thereto as shown in FIG. 8. A longitudinal grove 42 is formed at the base of the vertical leg 44 to provide a securing surface for one edge of the cap 40, the other edge being folded over the edge of the horizontal edge 36 in a standard hem 46, all of which may be accomplished in a standard roll-forming operation.

Turning to FIG. 10, there is seen a further alternative embodiment of a wall angle according to the present disclosure that is a modification of the embodiment of FIGS. 8 and 9. As such, the same reference numerals will be used with respect to the FIG. 10 embodiment, as well as the other illustrated embodiments, when referring to structures that correspond to those shown in FIGS. 8 and 9.

In the FIG. 10 embodiment, the wall angle 30 includes an additional tab 48 punched from the horizontal ledge 36. This tab 48 is bendable by a grid installer approximately 180° so as to lie against the flange 24 of a beam 22 whose edge is located by the vertical tab 32, thus more securely locating the beam relative to the wall angle. See FIG. 11. The tab 48 may be formed so that its free end is displaced slightly upwardly from the plane defined by the horizontal ledge 36 to make it easier for the installer to grasp the tab for bending. The end 50 of the tab 48 may also be formed with a generally concave shape for the same reason.

Figure 12:
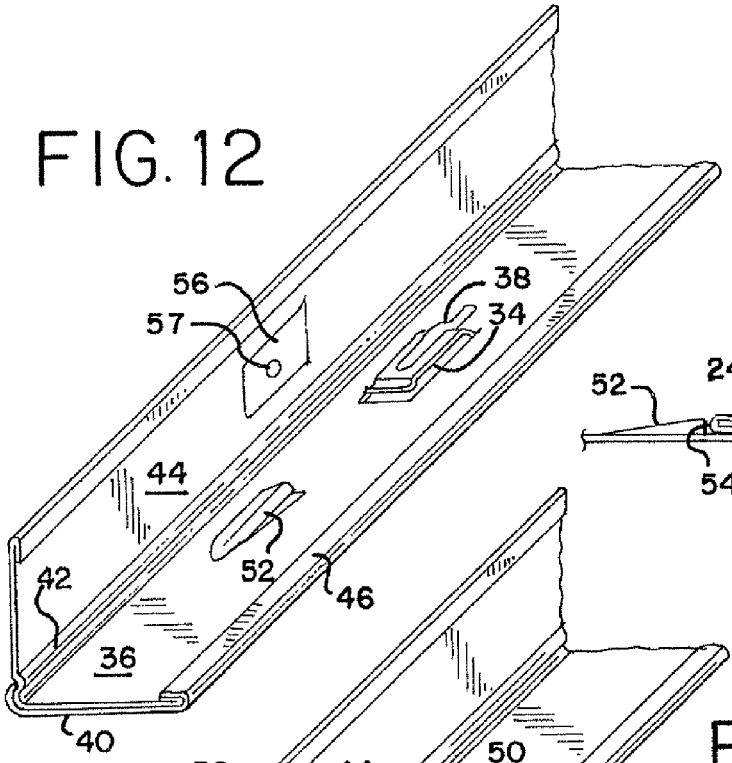
FIG. 12 is a perspective view of a sixth embodiment of a wall angle according to the present disclosure.
Figure 13:
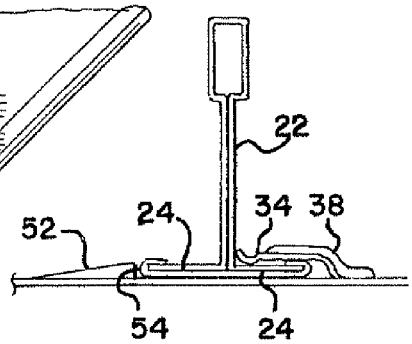
FIG. 13 is a front view of the wall angle of FIG. 12 in combination with a tee-runner, which is shown in profile.

FIGS. 12 and 13 show a further embodiment of a wall angle 30 according to the present disclosure that is also similar to the embodiment of FIGS. 8 and 9 with respect to the tab 34. However, in place of the tab 32, the wall angle 30 of FIGS. 12 and 13 includes a second tab 52 lanced from the horizontal ledge 36 of the wall angle 30. This second tab 52 has a free end 54 displaced upwardly from the horizontal plane defined by the horizontal ledge for engaging the edge of one of the flanges 24 to locate the beam 22. The other tab 34 holds the beam 22 in place. Preferably, the free end 54 of the tab 52 is bent downwardly to provide a larger surface for engagement with the edge of the flange.

Under certain circumstances, there may be a need to provide for a more secure attachment of the grid system to the wall angle. One such circumstance is where the suspension system is being installed in a region where seismic activity is relatively common. Securing the perimeter of the grid system to the wall angle helps to ensure that the suspended ceiling will not collapse during a seismic event due to the ends of the beams being displaced laterally off of the horizontal ledge of the wall angle. To this end, the vertical leg 44 of the wall angle 30 also preferably includes a "seismic" tab 56 that, after the runner is positioned relative to the wall angle by the tabs on the horizontal ledge 36 is bent outwardly from the vertical leg 44 of the wall angle so as to lie alongside the vertical web of the runner. The tab 56 includes an aperture 57 that serves as a pilot hole for receiving a screw or pop rivet (not shown), thus providing a positive attachment of the runner to the wall angle.

Figure 14:
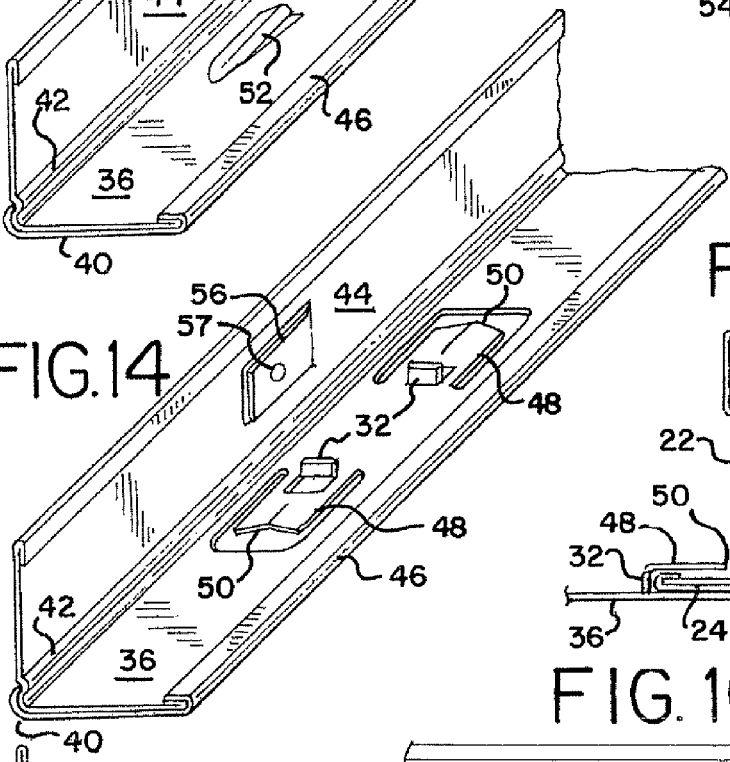
FIG. 14 is a perspective view of a seventh embodiment of a wall angle according to the present disclosure.
Figure 15:
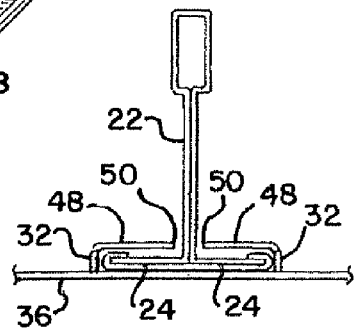
FIG. 15 is a front view of the wall angle of FIG. 14 in combination of a tee-runner, which is shown in profile.

FIGS. 14 and 15 show a further embodiment of a wall angle in accordance with the present disclosure that combines opposed pairs of locking tabs 48, similar to the FIG. 10 embodiment, with the seismic tab 56 as shown in FIG. 12.

Figure 16:
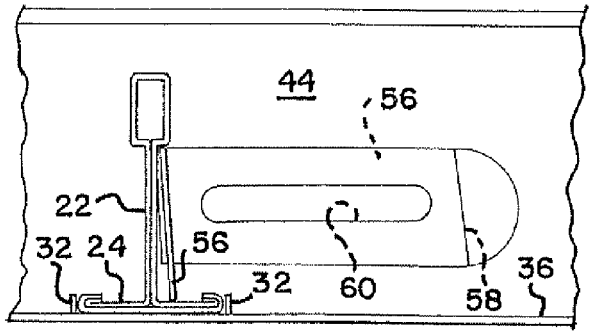
FIG. 16 is a front view of a wall angle having a tab on its vertical leg as an alternative to that shown in FIG. 14.
Figure 17:
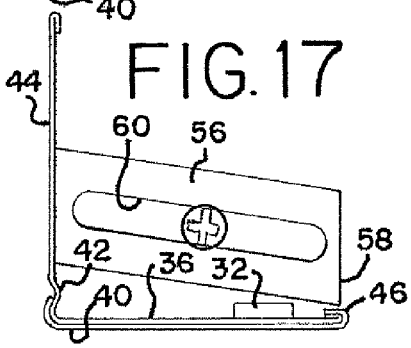
FIG. 17 is an end view of the wall angle of FIG. 16.

FIGS. 16 and 17 show a further embodiment of a wall angle according to the present disclosure that is similar to that shown in FIGS. 14 and 15 in that the horizontal ledge includes the vertical locating tabs 32 and the vertical leg includes a seismic tab 56. However, the seismic tab 56 is lanced from the vertical leg so that the hinge line formed between the tab and the vertical leg when the tab is folded out is at an angle relative to vertical (best seen in FIG. 16). As seen in FIG. 17, the angled hinge line results in the free end 58 of the tab 56 extending at an angle downwardly toward the horizontal ledge when the tab 56 is bent outwardly so that it closely lies over one of the flanges of the beam and inhibits upward movement of the beam relative to the wall angle. The tab 56 also includes a slot 60 for receiving a screw/rivet (not shown) that secures the tab 56 to the vertical web of the beam 22. The slot 60 permits limited movement of the grid toward and away from the wall angle, while the grid is still positively affixed thereto.

As can be appreciated, if the grid system extends more than the length of a single wall angle, care must be taken in locating the second wall angle to ensure that the proper center-to-center spacing of the pairs of locating tabs is maintained. To this end, another aspect of the present disclosure is providing the wall angle with complementarily-shaped and, preferably, interlocking end segments.

Figure 18:
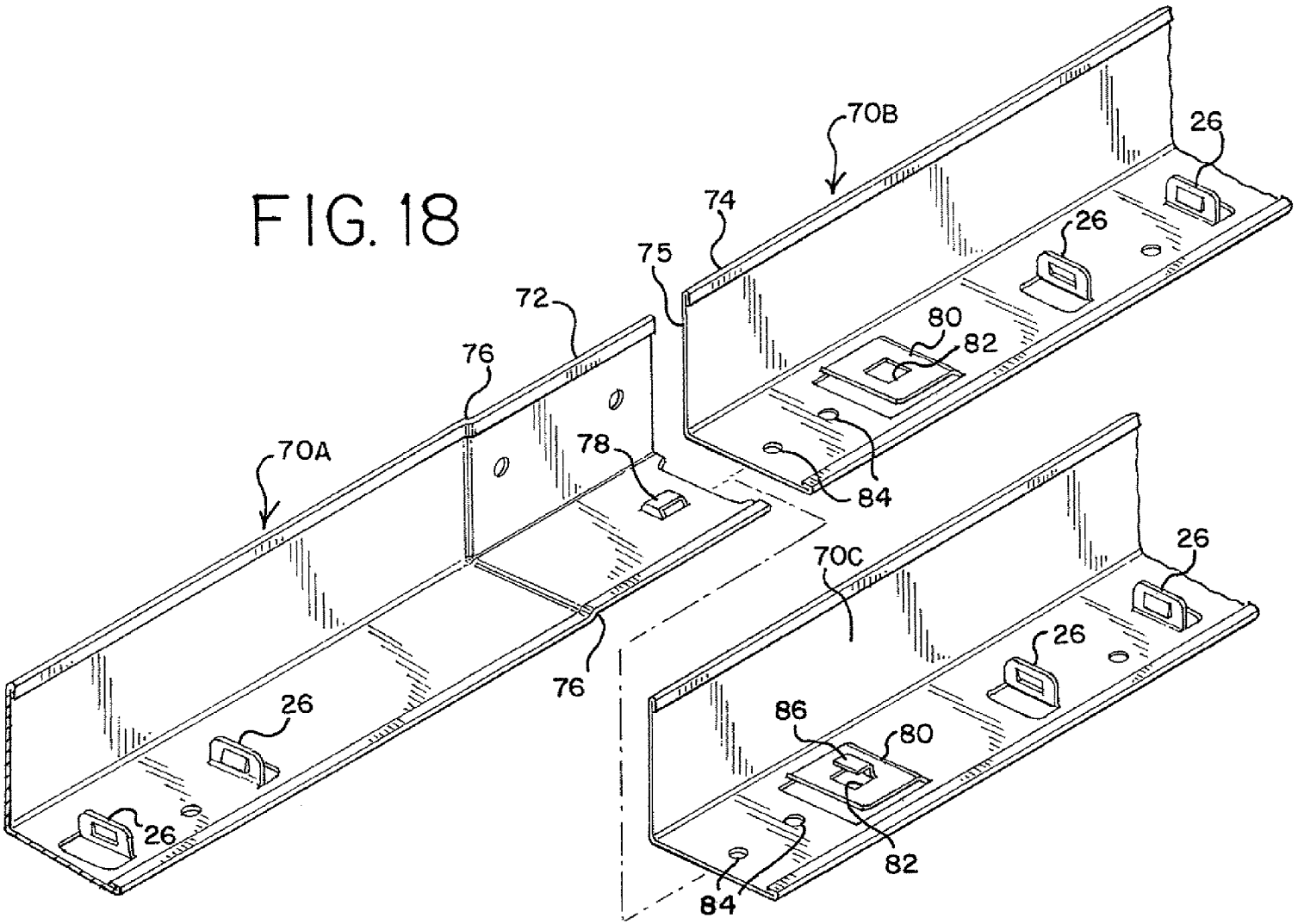
FIG. 18 is a fragmentary perspective view of the inter-connecting ends of wall angles in accordance with the present disclosure showing two alternatives for one of the ends.

With respect to FIG. 18, a wall angle 70A in accordance with the present disclosure has locating tabs 26, as shown and described in connection with FIGS. 1-5. As can be appreciated, however, the locating tabs could take any of the other forms discussed above. The wall angle 70A includes first end 72 that is formed so that the vertical and horizontal components of the wall angle are displaced or swaged inwardly and upwardly, respectively, relative to the vertical and horizontal components of the remainder of the wall angle. Assuming that the wall angle 70A is first secured in place, the complementarily-shaped end 74 of a second wall angle 70B is slid past the displaced end until its end 75 abuts the shoulder 76 that defines the transition between the end segment 72 and the remainder of the wall angle 70A. This abutting contact ensures that the proper center-to-center spacing of the pairs of locating tabs from one wall angle to the next is maintained.

In keeping with another aspect of the disclosure, the end segments of the wall angle are provided with complementary interlocking members to secure the adjacent wall angles to each other. With reference again to FIG. 18, the end 72 of the wall angle 70A is formed with a protrusion 78 lanced from the horizontal ledge of the wall angle so as to extend upwardly therefrom. The mating end segment 74 on wall angle 70B is formed with a tab 80 that slides over the protrusion 78 and includes an aperture 82 sized to receive and capture the protrusion 78. Disconnecting the end segment 74 from the end segment 72 requires deflection of the tab 80 to release the protrusion 78. The horizontal ledge of the end 74 also includes two apertures 84 that serve as pilot holes for receiving fasteners, such as screws, in order to provide a more permanent attachment of adjacent wall angles to each other, while the vertical leg of the end 72 includes two apertures 85 that serve as pilot holes for fasteners that both secure the ends 72, 74 to each other and the wall angles 70A, 70B to the wall.

Figure 19:
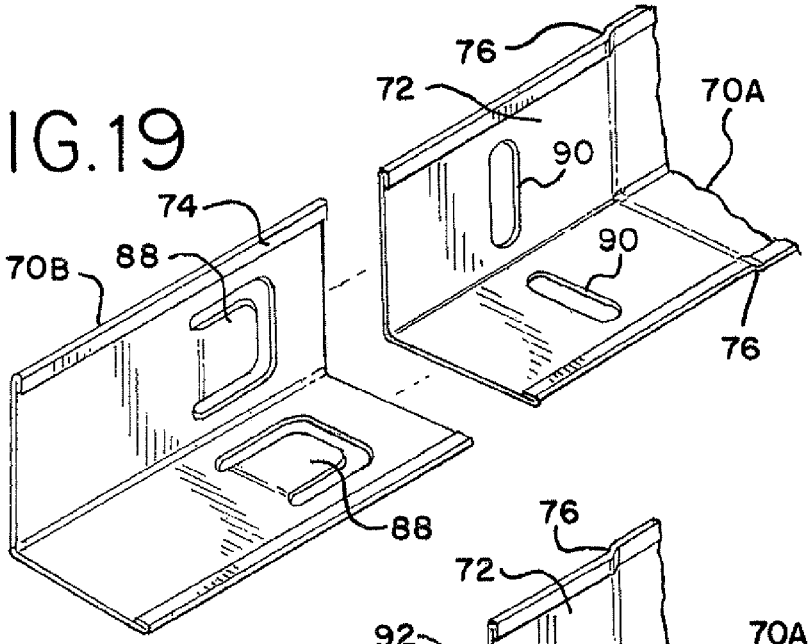
FIG. 19 is a first alternative to the inter-connecting ends shown in FIG. 18.
Figure 20:
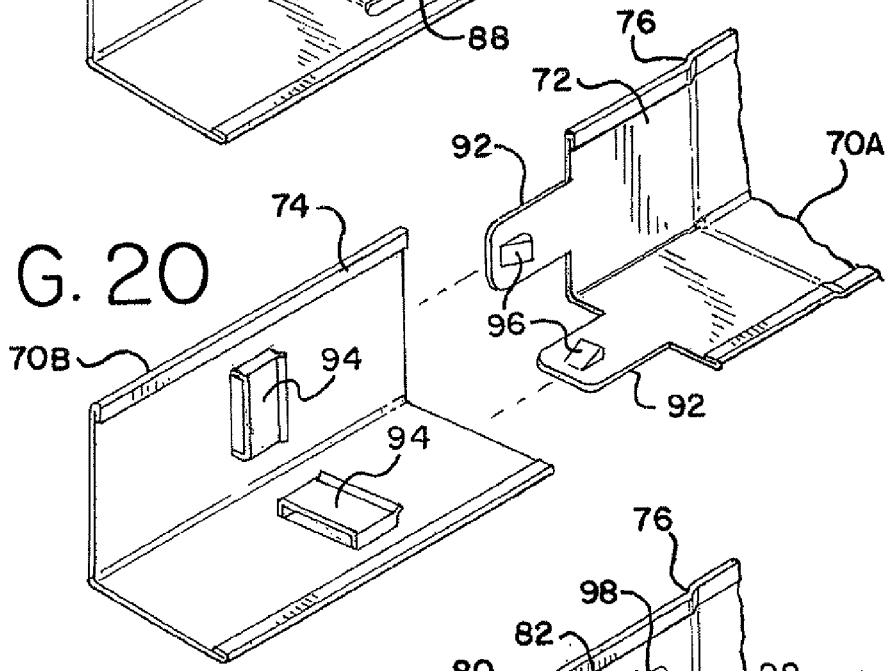
FIG. 20 is a second alternative to the inter-connecting ends shown in FIG. 18.
Figure 21:
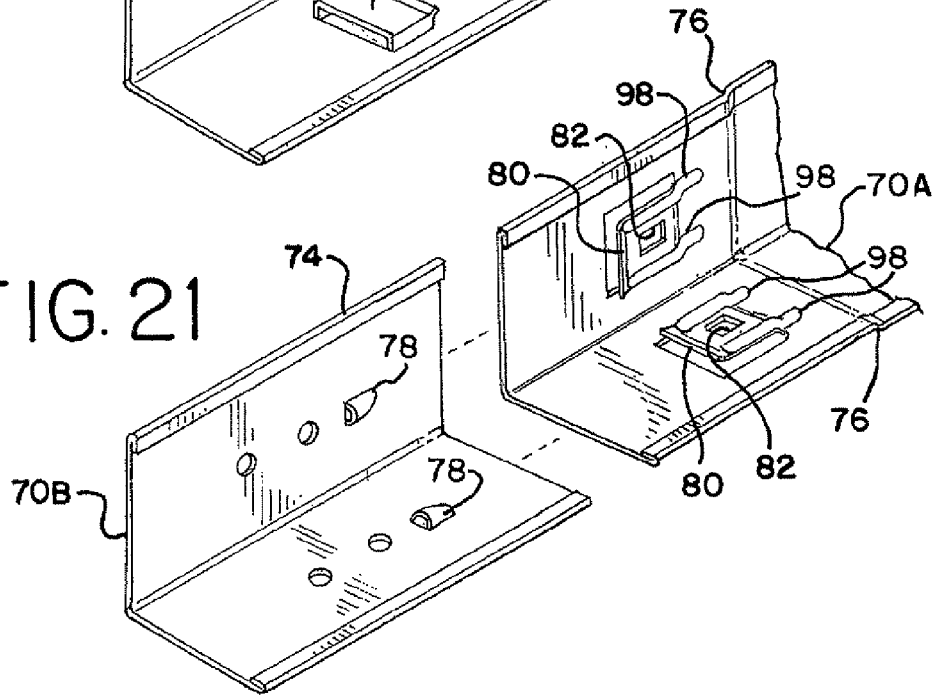
FIG. 21 is a third alternative to the inter-connecting ends shown in FIG. 18.

Variations on the interfitting and interlocking structures on the wall angle ends are contemplated and can take any of a number of different forms, all well within the capabilities of a person skilled in the art. For example, with reference to FIG. 18, the tab 80 on the second end segment 74 of wall angle 70C may be formed so that a cover 86 overlies the aperture. With reference to FIG. 19, one end segment 74 can be formed with an elongated tongue 88 formed on one or both of the vertical and horizontal legs of the wall angle (both, in the illustrated embodiment), with the complementary end 72 being formed with a slot 90 for receiving each of the tongues 88. With reference to FIG. 20, one end 72 can be formed with one or more tongues 92 that are received in slotted, raised segments 94, through which each of the tongues extends when the ends are connected. The tongue 92 is preferably formed with a detent 96 that prevents withdrawal of the tongue 94 from the slotted, raised segment 94 after interconnection of the wall angles. The base of the tongue 92 may also be provided with one or more embossments 98 to further stiffen the tongue. FIG. 21 discloses an embodiment functionally similar to that in FIG. 18, except that the protrusion 78 is differently shaped, as is the corresponding aperture 82 and the tab 80. The tab 80 further includes stiffening embossments 98.

While the wall angle has been described in terms of certain specific embodiments, there is no intention to limit the invention to the same. Instead, the invention is defined by the scope of the following claims.

The invention claimed is:

1. A wall angle for a suspended ceiling having a cross section forming a substantially right angle with a vertical leg and a horizontal leg, the horizontal leg being adapted to support an inverted tee-runner having a vertical web and opposed flanges that rest on the horizontal leg, the horizontal leg being formed with a plurality of pairs of tabs, at least one tab of each pair being upwardly extending and vertically-oriented, the tabs in each pair being spaced apart a distance sufficient to accommodate the width of the opposed flanges of the tee-runner; at least one of the tabs in each pair having a downwardly extending detent adapted to permit installation of a tee-runner, but to inhibit removal of the tee-runner, the vertical leg further comprising a tab that is bendable so as to overlie the horizontal leg and having a slot therein for receiving a screw for attachment to the vertical web of a tee-runner so as to allow limited movement of the tee-runner toward and/or away from the vertical leg of the wall angle.

2. The wall angle of claim 1 wherein the tab extends downwardly toward the horizontal leg when bent outwardly from the vertical leg.

3. The wall angle of claim 1 wherein the horizontal leg includes a plurality of pairs of vertical tabs, the vertical tabs in each pair being spaced a distance approximately equal to the flanges of the tee-runner.

4. A wall angle for a grid for a suspended ceiling having a cross section forming a substantially right angle with a vertical leg and a horizontal leg, the vertical leg including a tab lanced therefrom that is bendable so as to overlie the horizontal leg and adapted to be secured to the vertical web of a tee-runner, wherein the tab has a slot therein for receiving a screw for attachment to the vertical web of a tee-runner so as to allow limited movement of the tee-runner toward and/or away from the vertical leg of the wall angle.

5. The wall angle of claim 4 wherein the tab extends downwardly toward the horizontal leg when bent outwardly from the vertical leg.

6. The wall angle of claim 4 wherein the horizontal leg includes a plurality of pairs of vertical tabs, the vertical tabs in each pair being spaced a distance approximately equal to the flanges of the tee-runner.

* * * * *